US008870023B2

(12) United States Patent
Tsai

(10) Patent No.: US 8,870,023 B2
(45) Date of Patent: Oct. 28, 2014

(54) CUP RACK

(75) Inventor: Tsung-Yu Tsai, Changhua County (TW)

(73) Assignee: Dongguan Master United Plastic & Hardware Products Co., Ltd., Dongguan, Guandong Province (CN)

( * ) Notice: Subject to any disclaimer, the term of this patent is extended or adjusted under 35 U.S.C. 154(b) by 166 days.

(21) Appl. No.: 13/618,924

(22) Filed: Sep. 14, 2012

(65) Prior Publication Data

US 2014/0076919 A1 Mar. 20, 2014

(51) Int. Cl.

| | |
|---|---|
| ***B65H 3/44*** | (2006.01) |
| ***A47F 1/04*** | (2006.01) |
| ***A47F 7/00*** | (2006.01) |

(52) U.S. Cl.

USPC ..... 221/193; 221/199; 221/309; 221/61; 221/256; 221/185; 221/63; 211/59.2; 211/113; 211/26; 211/85.31; 99/289 R; 99/290; 99/295; 312/45

(58) Field of Classification Search

CPC ..... A47F 1/12; A47F 1/08; A47F 1/10; A47F 1/04; A47F 7/00; G07F 11/34; B65D 83/0805; B42D 5/005; B65H 3/44; A47K 2010/3266; A47K 10/424; A47K 10/3818

USPC ..... 221/193, 199, 309, 61, 256, 185, 63; 99/289 R, 290, 295; 211/59.2, 113, 211/85.31, 26; 312/45

See application file for complete search history.

(56) References Cited

U.S. PATENT DOCUMENTS

| | | | | |
|---|---|---|---|---|
| 1,343,974 | A * | 6/1920 | Jandron | 312/42 |
| 2,119,700 | A * | 6/1938 | Burgess | 211/59.2 |
| 2,692,053 | A * | 10/1954 | Calhoun et al. | 211/59.2 |
| 3,184,104 | A * | 5/1965 | De Domenico et al. | 221/92 |
| 3,265,246 | A * | 8/1966 | Messenger | 221/283 |
| 3,371,795 | A * | 3/1968 | Rosonke | 211/14 |
| 3,627,317 | A * | 12/1971 | Whitsitt | 273/447 |
| 4,015,885 | A * | 4/1977 | Baggaley | 312/42 |
| 4,476,996 | A * | 10/1984 | Moore et al. | 221/61 |
| 4,828,144 | A * | 5/1989 | Garrick | 221/309 |
| 5,700,075 | A * | 12/1997 | Perone | 312/45 |
| 5,855,422 | A * | 1/1999 | Naef | 312/42 |
| 6,006,929 | A * | 12/1999 | Leonard | 211/113 |
| 6,234,330 | B1 * | 5/2001 | Gray | 211/106 |
| 6,340,091 | B1 * | 1/2002 | Romeo et al. | 211/59.2 |
| 6,460,701 | B1 * | 10/2002 | Nytko | 206/349 |
| 6,581,789 | B1 * | 6/2003 | Spanski et al. | 211/106 |
| 7,303,095 | B2 * | 12/2007 | Nagelski et al. | 221/256 |
| 7,398,888 | B1 * | 7/2008 | Nowak | 211/59.2 |
| 7,837,044 | B2 * | 11/2010 | Whitty | 211/106 |
| 8,418,859 | B2 * | 4/2013 | Chen | 211/59.2 |
| 2006/0186000 | A1 * | 8/2006 | Gregory et al. | 206/315.9 |
| 2012/0006770 | A1 * | 1/2012 | Chen | 211/59.2 |
| 2014/0034666 | A1 * | 2/2014 | Woods et al. | 221/267 |

FOREIGN PATENT DOCUMENTS

| | | |
|---|---|---|
| TW | M406381 | 7/2011 |
| TW | M415672 | 11/2011 |
| TW | M420242 | 1/2012 |

* cited by examiner

*Primary Examiner* — Rakesh Kumar
(74) *Attorney, Agent, or Firm* — Muncy, Geissler, Olds & Lowe, P.C.

(57) ABSTRACT

A cup rack includes a cup rack body for receiving multiple cups in a stack, and a base for supporting the storage cups in the cup rack body and defining an access port for finger access to pick up the cups individually.

4 Claims, 5 Drawing Sheets

CUP RACK

BACKGROUND OF THE INVENTION

1. Field of the Invention

The present invention relates to racks for holding things and more particularly, to a cup rack for holding cups or like objects.

2. Description of the Related Art

Taiwan Utility No. M406381 discloses a cup rack, which comprises a bottom rod and two side rods for holding a number of cups, and a stop rod extended from the bottom rod for stopping the arranged cups from falling. This design of cup rack has no baffle means arranged at the top. Thus, this cup rack can simply be set in vertical, and its structural configuration is not changeable.

Taiwan Utility No. M415672 discloses a rack for holding cap-shaped coffee powder balls. According to this design, the rack comprises an oblique guide for receiving the rims of cap-shaped coffee powder balls. However, if the rims of cap-shaped coffee powder balls are soft or softened, the oblique guide will be unable to support the storage cap-shaped coffee powder balls in place.

Taiwan Utility No. M420242 discloses a box rack, comprising a base member, and an inner holder member mounted at the base member for holding storage boxes. This design of box rack is complicated, not convenient for use.

SUMMARY OF THE INVENTION

The present invention has been accomplished under the circumstances in view. It is the main object of the present invention to provide a cup rack, which is practical for holding a large number of cups in good order. The cup rack comprises a cup rack body and a base. The cup rack body defines a top opening, a bottom opening, and a passage in communication between the top opening and the bottom opening for accommodating cups. The passage defines opposing left and right sides respectively facing opposing top and bottom sides of each storage cup, and opposing front and rear sides respectively facing the body of each storage cup. The base comprises two limiter members, a rear baffle member and a receiving member. The limiter members have the top ends thereof respectively connected to the cup rack body and disposed at the left and right sides of the passage. The rear baffle member has the top end thereof connected to the cup rack body and disposed at the rear side of the passage. The receiving member has the rear end thereof connected to the bottom end of each rear baffle member, and the front end thereof defining with the two limiter members an access port for the passing of the cups. Thus, the cups stored in the cup rack can be taken out through the access port individually.

Preferably, the rear baffle member comprises two baffle rods. The receiving member comprises two support rods and one upright rod. The support rods have the respective rear ends thereof respectively connected to the baffle rods and inclined downwardly relative to the baffle rods. The upright rod of the receiving member has the two opposing ends thereof respectively connected to the front ends of the support rods in a vertical position on the support rods. Thus, the upright rod can stop the storage cups in the base.

DETAILED DESCRIPTION OF THE INVENTION

Figure 1:
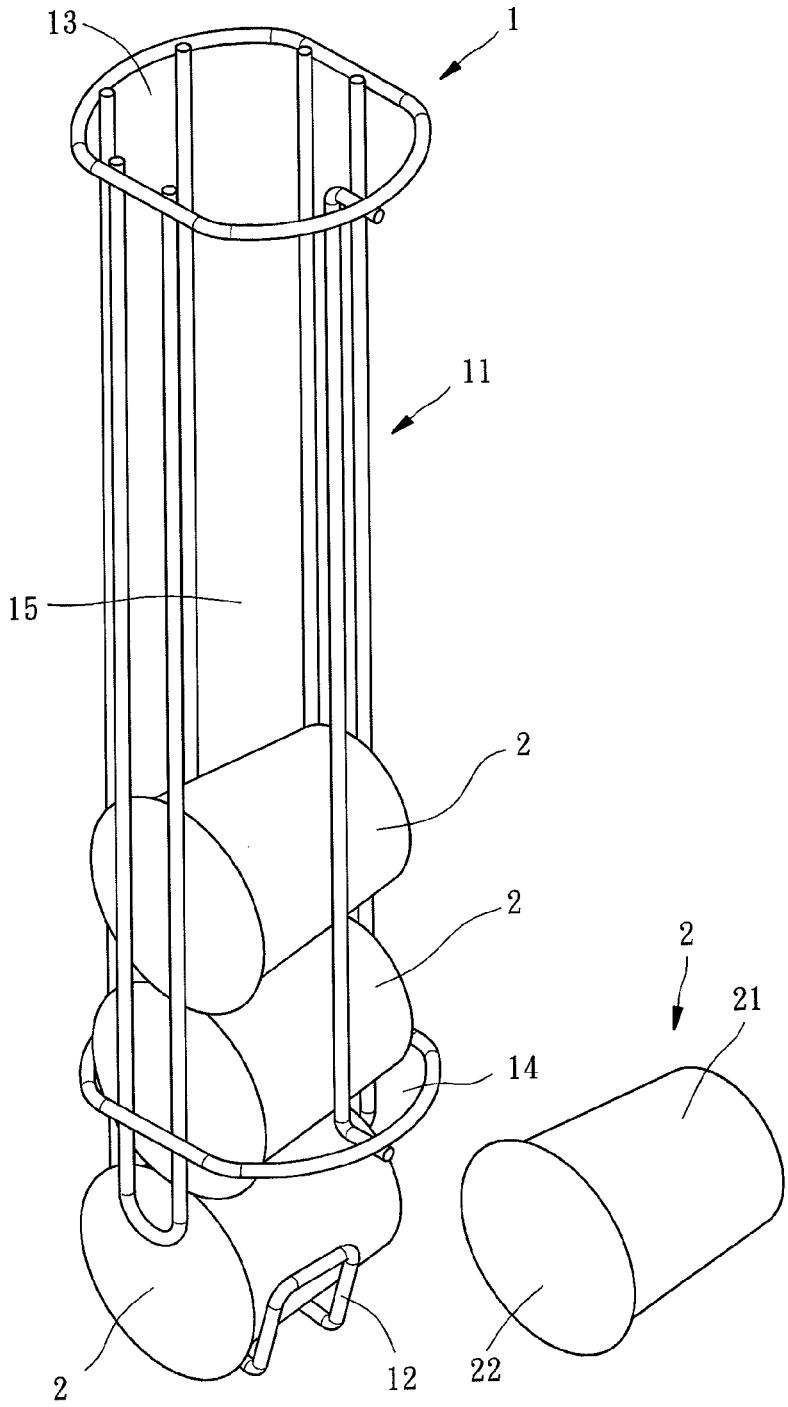
FIG. 1 is an elevational view of a cup rack in accordance with the present invention.

Referring to FIG. 1, a cup rack 1 in accordance with the present invention is shown for holding a plurality of cups 2 or like objects in a good order. In this embodiment, the cups 2 each comprise a cup body 21, and a seal film 22 for sealing coffee, tea, or any of a variety of other powdered or grained food or brewing materials in the cup body 21 after filling of nitrogen gas in the cup body 21. The cup rack 1 comprises a cup rack body 11 and a base 12. The cup rack body 11 defines a top opening 13, a bottom opening 14, and a passage 15 in communication between the top opening 13 and the bottom opening 14 for accommodating the cups 2 in such a manner that the top and bottom sides of the cups 2 respectively face the opposing left and right sides of the passage 15 and the body of each cup 2 faces the opposing front and rear sides of the passage 15, i.e., the cups 2 are individually put into the passage 15 through the top opening 13.

The base 12 is adapted to receive the cups 2, wherein the lowest cup 2 can be taken out of the cup rack 1 through the base 12. This will be explained further.

Figure 2:
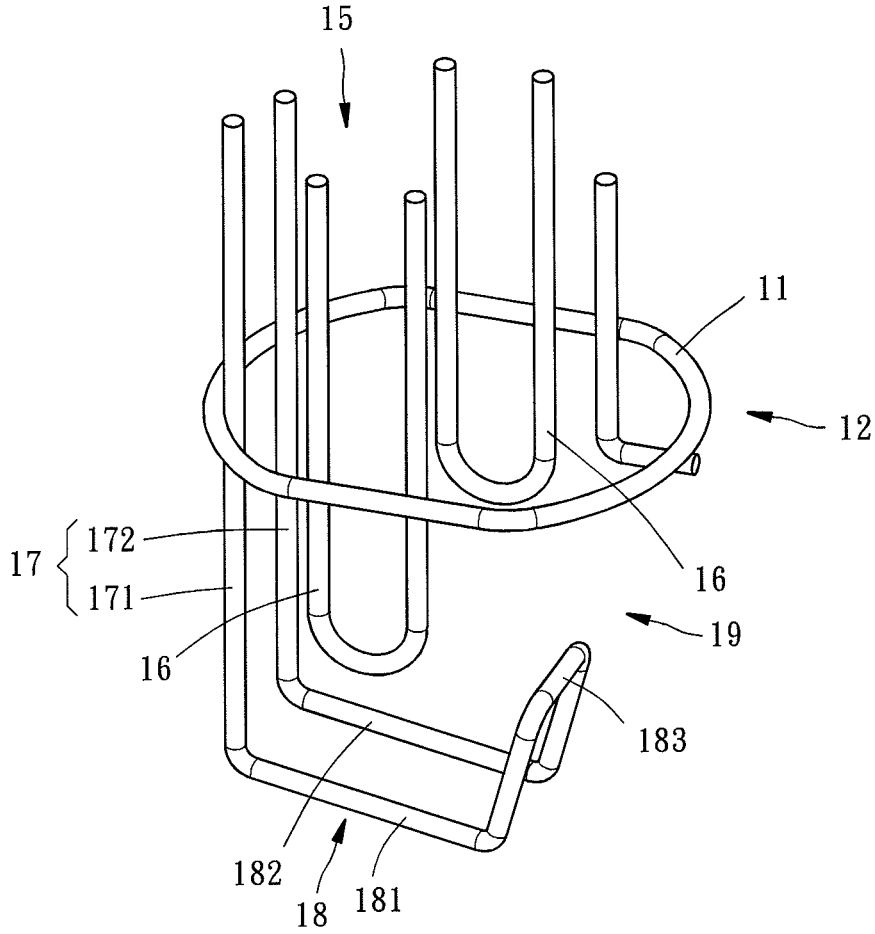
FIG. 2 is an enlarged view of the base of the cup rack in accordance with the present invention.

Referring to FIG. 2, an enlarged view of the base 12 of the cup rack 1 is shown. As illustrated, the base 12 comprises two limiter members 16, a rear baffle member 17, and a receiving member 18. The two limiter members 16 have the respective top ends thereof connected to the cup rack body 11 and respectively disposed at the left and right sides relative to the passage 15. The rear baffle member 17 has the top end thereof connected to the cup rack body 11 and disposed at the back side relative to the passage 15. The receiving member 18 has the rear end thereof connected to the bottom end of the rear baffle member 17, and the front end thereof defining with the two limiter members 16 an access port 19. The receiving member 18 is adapted to receive the cups 2 shown in FIG. 1, wherein the cups 2 can pass through the access port 19, i.e., the access port 19 allows the cups 2 to pass therethrough.

In this embodiment, the two limiter members 16, the rear baffle member 17 and the receiving member 18 are preferably made of stainless steel wire rods, iron wire rods, or plated metal wire rods. Iron wire rods electroplated with chrome to provide corrosion resistance. Other corrosion resistant material may be used. The rear baffle member 17 comprises two baffle rods 171;172. The receiving member 18 comprises two support rods 181;182 and one upright rod 183. The two support rods 181;182 have the respective rear ends thereof respectively connected to the two baffle rods 171;172 in a downwardly inclined manner relative to the two baffle rods 171;172. The upright rod 183 has the two opposing ends thereof respectively connected to the front ends of the two support rods 181;182 and kept in vertical on the support rods 181;182. Subject to the configuration of the receiving member 18, the lowest cup 2 will naturally move along the support rods 181;182 to the front ends of thereof and will be prohibited by the upright rod 183 from moving out of the base 12.

Figure 3:
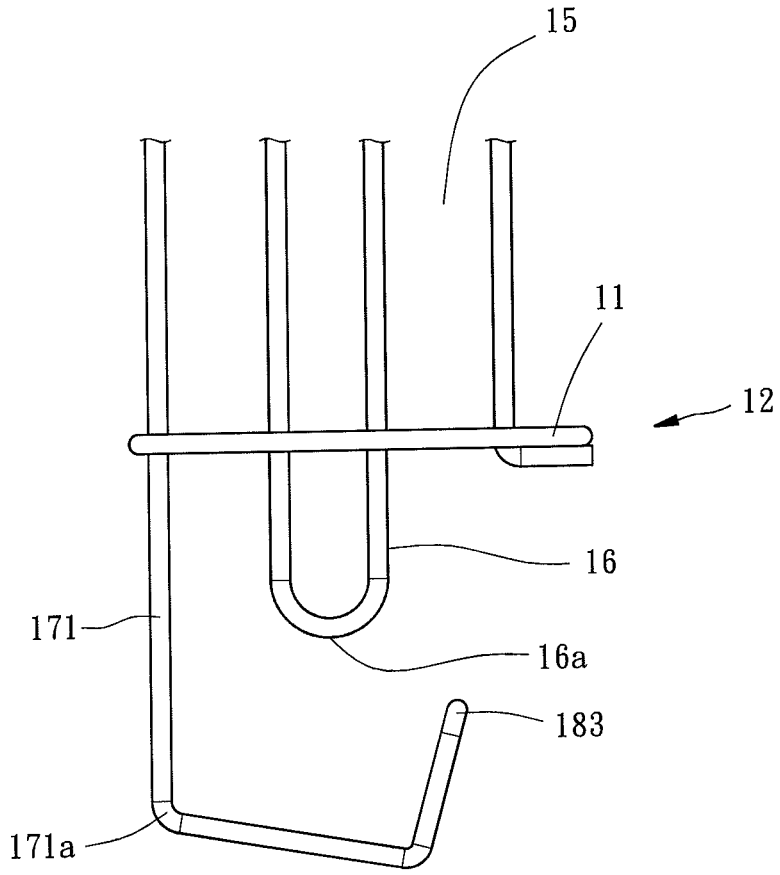
FIG. 3 is a left side view of FIG. 2.

Referring to FIG. 3, a left side view of FIG. 2 is shown. The bottom end 171*a* of the baffle rod 171 is disposed below the elevation of the bottom ends 16*a* of the limiter members 16. The upright rod 183 is disposed below the elevation of the limiters 16. Actually, the two baffle rods 171;172 have the same length, i.e., the bottom ends of the baffle rods 171;172 are disposed below the elevation of the bottom ends of the limiter members 16. The elevational clearance between the bottom end 171*a* of the baffle rod 171 and the bottom ends 16*a* of the limiter members 16 facilitates finger access to pick up the cup 2. In actual practice, the bottom ends 16*a* of the limiter members 16 can be lower than the elevation of the bottom ends 17*a* of the baffle rods 171;172, and therefore what illustrated in FIG. 3 is not a limitation.

Figure 4:
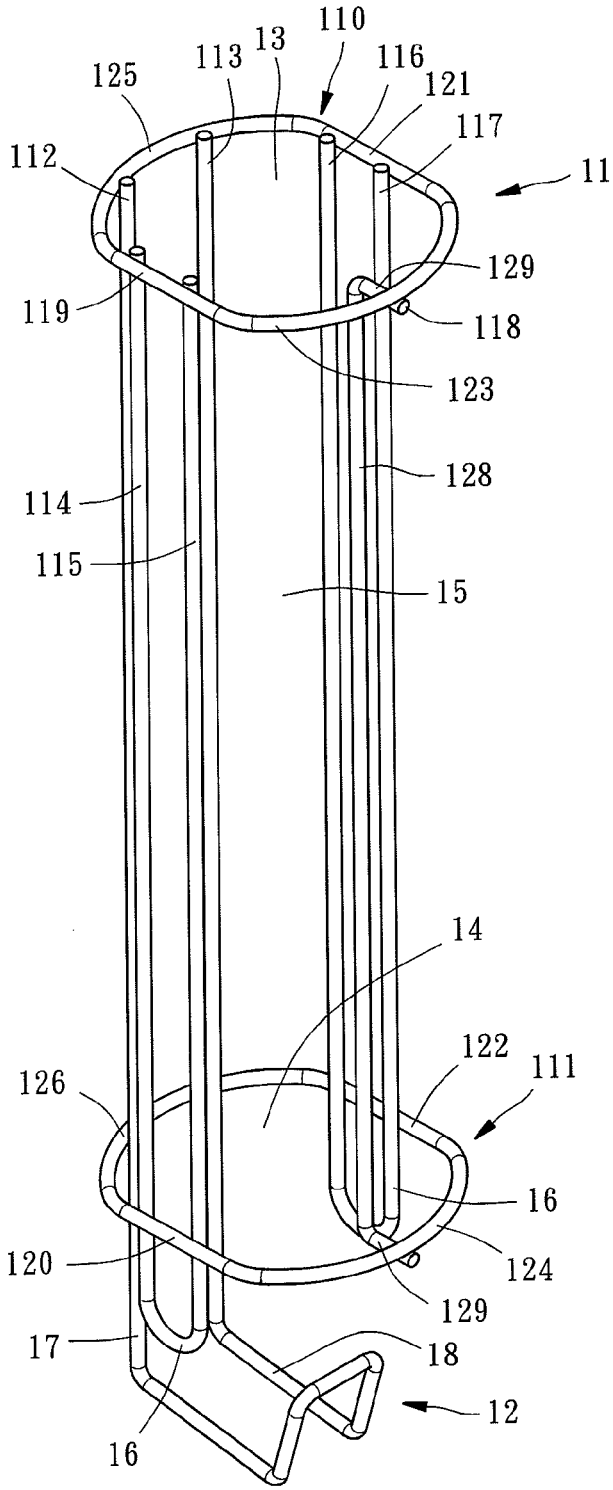
FIG. 4 is an oblique top elevation of the cup rack shown in FIG. 1.

Referring to FIG. 4, the cup rack body 11 comprises two rings 110;111, two rear upright rods 112;113, two left upright rods 114;115, two right upright rods 116;117, and a front rod 118. Each ring 110;111 comprises a left straight segment 119;120, a right straight segment 121;122, a front arched segment 134;124, and a rear arched segment 125;126. The top and bottom ends of the rear upright rods 112;113 are respectively connected to the respective inner sides of the rear arched segments 125;126 of the rings 110;111 in a parallel manner. The top and bottom ends of the left upright rods 114;115 are respectively connected to the respective inner sides of the left straight segments 119;120 of the rings 110;111 in a parallel manner. The top and bottom ends of the right upright rods 116;117 are respectively connected to the respective inner sides of the right straight segments 121;122 of the rings 110;111 in a parallel manner. The top and bottom ends of the front rod 118 are respectively connected to the respective inner sides of the front arched segments 123;124 of the rings 110;111 in a parallel manner. Further, the two rings 110;111 define the top opening 13 and the bottom opening 14 respectively. The passage 15 is defined by the two rear upright rods 112;113, the two left upright rods 114;115, the two rear upright rods 116;117 and the front rod 118. It is to be noted that the two limiter members 16 of the base 12 are respectively formed integral with the left upright rods 114;115 and the right upright rods 116;117. The rear baffle members 17 and receiving member 18 of the base 12 are formed integral with the two rear upright rods 112;113, i.e., these components are made by bending one single piece of metal wire rod into shape. In actual application, the cup rack body 11 can be made of a meshed or plate member and arranged around the two rings 1110;111 to constitute an enclosed or semi-enclosed passage structure, forming the aforesaid passage 15, and therefore, the cup rack body 11 is not limited to the aforesaid design.

More particularly, the front rod 118 comprises a long straight segment 128 and two short straight segments 129. The two short straight segments 129 are respectively disposed at the top and bottom ends of the long straight segment 128 at a predetermined angle and kept facing each other. Thus, by means of changing the lengths of the short straight segments 129, the front-back width of the passage 15 is relatively controlled.

Figure 5:
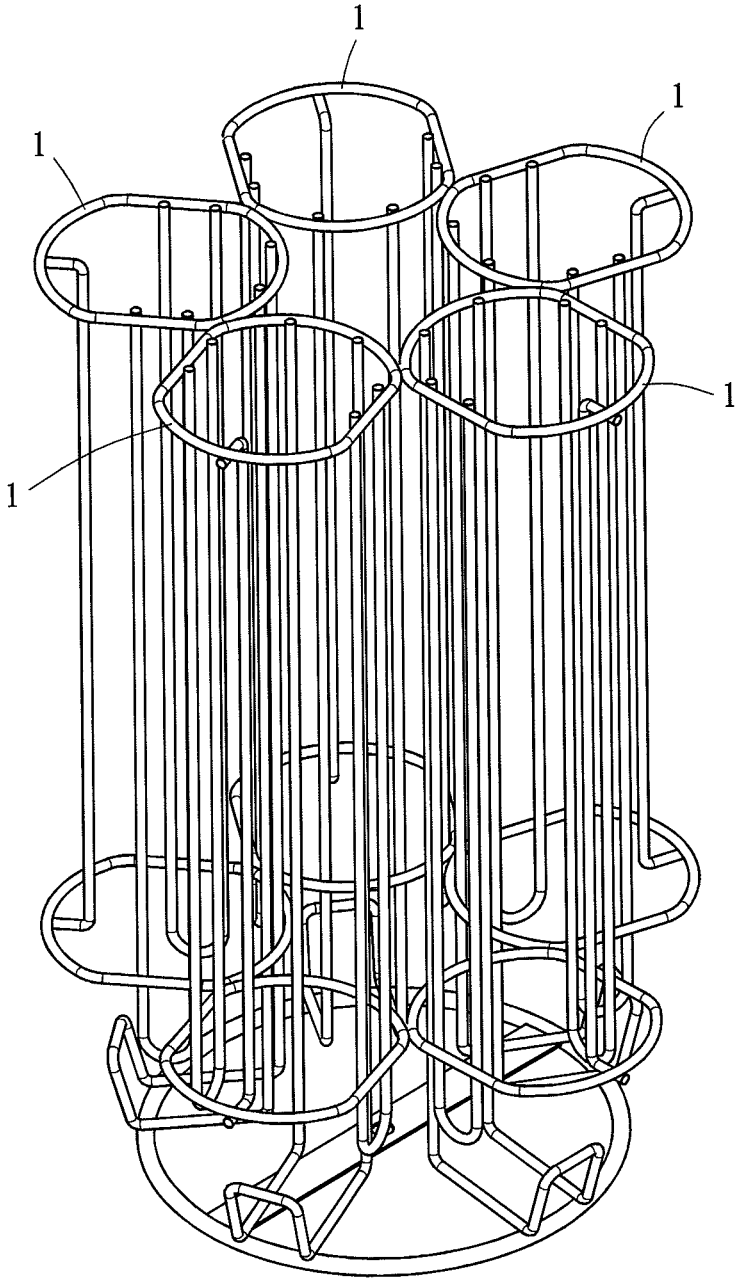
FIG. 5 is an elevational view illustrating 5 pcs of cup racks arranged together in accordance with the present invention.

FIG. 5 illustrates 5 pcs of the cup racks arranged together, forming a cup rack combination. As illustrated, these cup racks are abutted against one another side by side, and each two adjacent cup racks are connected together. In actual application, any predetermined number of cup racks can be arranged together.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A cup rack for holding a plurality of cups, each said cup comprising a body and opposing top and bottom sides, the cup rack comprising:

a cup rack body comprising a top opening, a bottom opening and a passage in communication between said top opening and said bottom opening for accommodating said cups, said passage having a left side, a right side, a front side and a rear side, said left and right sides of said passage respectively facing opposing top and bottom sides of each said cup, said front and rear sides of said passage respectively facing a body side of each said cup, said cup rack body further comprising two rings, two rear upright rods, two left upright rods, two right upright rods and a front rod, each said ring comprising opposing left and right straight segments and opposing front and rear arched segments, said rear upright rods having respective opposing top and bottom ends thereof respectively connected to respective inner sides of the rear arched segments of said two rings and kept in parallel, said left upright rods having respective opposing top and bottom ends thereof respectively connected to respective inner sides of the left straight segments of said two rings and kept parallel to each other, said right upright rods having respective opposing top and bottom ends thereof respectively connected to respective inner sides of the right straight segments of said two rings and kept parallel to each other, said front rod having opposing top and bottom ends thereof respectively connected to respective inner sides of the front arched segments of said two rings, said two rings respectively defining said top opening and said bottom opening therein, said rear upright rods, said left upright rods, said right upright rod, and said front rod being arranged to jointly define said passage; and a base comprising two limiter members, a rear baffle member and a receiving member, said limiter members each having a top end thereof respectively connected to said cup rack body and disposed at the left and right sides of said passage, said rear baffle member having a top end thereof connected to said cup rack body and disposed at the rear side of said passage, said receiving member having a rear end and a front end, said rear end of said receiving member thereof connected to a bottom end of said rear baffle member, said front end of said receiving member and said two limiter members jointly defining an access port for passing said cups.

2. The cup rack as claimed in claim 1, wherein said rear baffle member comprises two baffle rods; said receiving member comprises two support rods and an upright rod, said support rods each having a rear end, said two rear ends of support rods being respectively connected to said baffle rods in a downwardly inclined manner relative to said baffle rods, said upright rod of said receiving member having two opposing ends thereof respectively connected to respective front ends of said support rods in a vertical position on said support rods.

3. The cup rack as claimed in claim 2, wherein said two baffle rods have respective bottom ends thereof disposed below the elevation of bottom ends of said limiter members; said upright rod is disposed below the elevation of said two limiter members.

4. The cup rack as claimed in claim 1, wherein said front rod comprises a long straight segment and two short straight segments, said two short straight segments being respectively connected to opposing top and bottom ends of said long straight segment at a predetermined angle and kept facing each other.

* * * * *